US005921868A

United States Patent [19]

DiMartino

[11] Patent Number: 5,921,868

[45] Date of Patent: Jul. 13, 1999

[54] GOLF PUTTER

[76] Inventor: William David DiMartino, 100 St. Andrews Cir., New Bern, N.C. 28562

[21] Appl. No.: 08/995,721

[22] Filed: Dec. 22, 1997

Related U.S. Application Data

[51] Int. Cl.[6] ..... A63B 53/04

[52] U.S. Cl. ..... 473/254; 473/252; 473/340

[58] Field of Search ..... 473/238, 242, 473/250, 251, 252, 253, 254, 255, 340, 341

[56] References Cited

U.S. PATENT DOCUMENTS

| | | | |
|---|---|---|---|
| 3,880,430 | 4/1975 | McCabe | 473/253 |
| 4,136,877 | 1/1979 | Antonious | 473/254 |
| 4,508,350 | 4/1985 | Duclos | 473/254 |
| 5,248,145 | 9/1993 | Brown | 473/254 |
| 5,423,545 | 6/1995 | Narry | 473/253 |

*Primary Examiner*—William M. Pierce

[57] ABSTRACT

A golf putter has a head and shaft, with the head having a bottom formed with a recess and a narrow annular peripheral bottom flat face extending from the recess, which flat face contacts the putting surface. The golfer, by tactile means, senses the limited surface face portion contact with the putting surface and whether the head is correctly anchored flat parallel to the putting surface. If necessary, the golfer adjusts the putter head to be flat parallel to the putting surface. The golfer consistently perceives if and when the putter head is correctly level with the plane of the putting surface. The back portion of the head is provided with vertically displaced alignment elements. The golfer, after the annular flat bottom face is correctly anchored, then by eye aligns the alignment elements. The combination of the correct level anchoring of the putter head followed by the correct eye alignment of the alignment elements ensures that the golfer's head is correctly positioned behind the ball and in true alignment for putting. The alignment elements are an upper T-shaped cut-out and a lower precision matched and colored T-shaped insert. The golfer's eye matches the insert fully within the cut-out and in doing so confirms correct golfer head alignment directly over the true target line of the ball.

23 Claims, 3 Drawing Sheets

11
10
3
4
27
28
29
43
12
18
24
17
26
30

19
20
15
11
43
12
18
13
17
35
16
50
A
AB 11
12
15
43
20
22
50
13
14
31
30
32
58
27a
33
23
35
16
B
AB

FIG.4
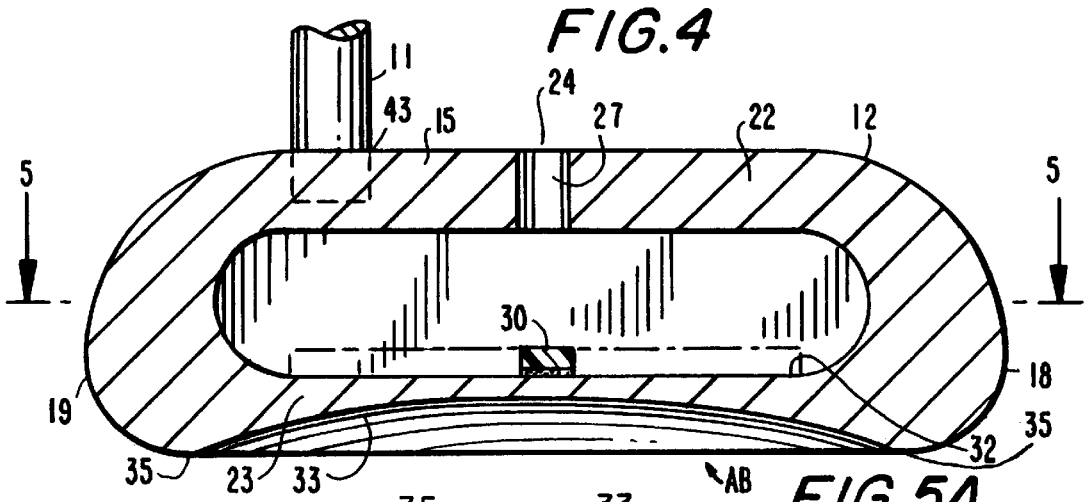
FIG.5A
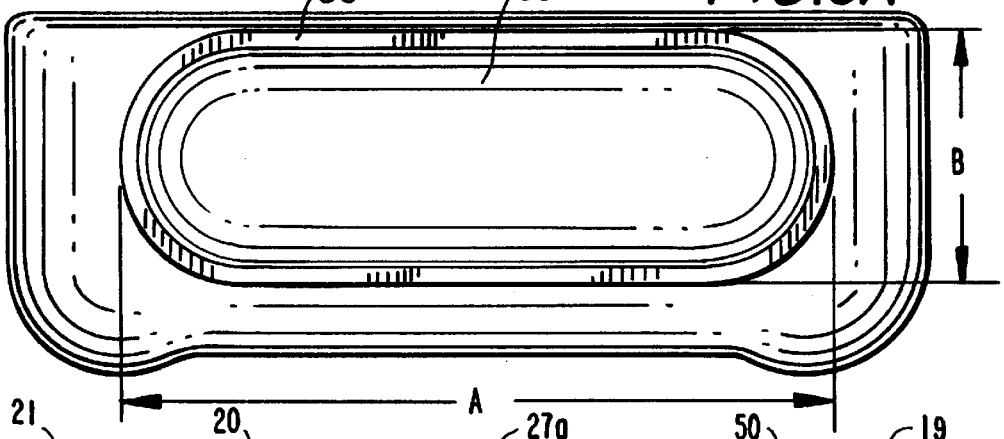
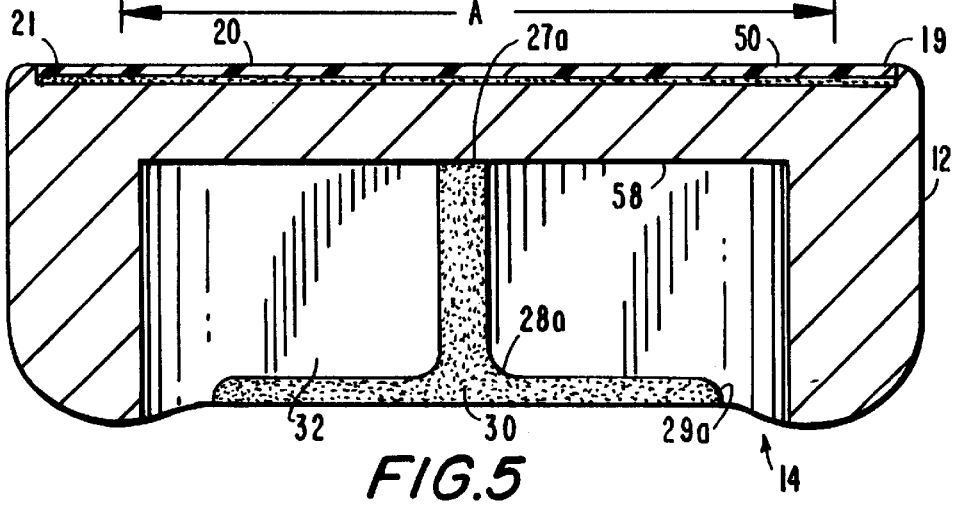
FIG.5

GOLF PUTTER

BACKGROUND OF THE INVENTION

1. Field of the Invention

The invention relates to golf putters. More specifically this invention relates to improvements in golf putters which provide correct golfer head alignment for putting.

2. Background and Discussion of the Prior Art

Golfer head and eye alignment are important to successful putting. A golfer's eyes must be directly over the true target line of the ball in order to maximize the possibility of sinking the putt. If the golfer's eyes are not directly over the true target line, and the golfer perceives that it is so when it is not, then even if the golfer correctly strikes the ball, the putt will likely miss the target.

The bottom or sole of many conventional putters was either curved or rounded so that the putter head would rock or move, and in turn cause the golfer's head to be improperly aligned. And even where the bottom or sole of the head was an extended flat surface, there was the prospect that while part of the sole rested on the putting surface another part of the sole was not, and yet the golfer misperceived that there was co-planar level contact of the extended sole surface with the putting surface. Furthermore, golf putters were generally directed to merely aligning the front face of the putter with the ball, and the prior art generally disregarded or failed to fully appreciate the need to simultaneously achieve and maintain correct golfer head alignment and the golfer having a true perception of same.

Prior art constructions that were generally directed to putter head alignment with respect to the ball are disclosed in Raub, U.S. Pat. No. 3,387,845, granted Jun. 11, 1968; McCabe, U.S. Pat. No. 3,880,430, granted Apr. 29, 1975; Antonious, U.S. Pat. No. 4,136,877 granted Jul. 30, 1979; Lee, U.S. Pat. No. 4,844,468, granted Jul. 4, 1989; Paulin, U.S. Pat. No. 4,141,556, granted Feb. 27, 1979; Narry, U.S. Pat. No. 5,423,545, granted Jun. 13, 1996; and Culpepper, U.S. Pat. No. 5,462,279, granted Oct. 31, 1995.

One attempt to correctly rest the putter head on the putting surface and provide golfer head alignment is disclosed in Tsao, U.S. Pat. No. 4,722,528, granted Feb. 2, 1988. Tsao discloses and was directed to a weighted, extended flat surface, attachable sole plate. This weighted flat sole plate could, however, provide a false perception where part of the sole was resting on the putting surface while another part was not. This false perception would cause the golfer to misperceive level contact of the putter head with the putting surface, when it was not so. Further, Tsao provided multiple skewered sighting lines (with duplicate lines required for left and right eye sighting) disposed within a central cup. These multiple skewered sighting lines were confusing, would vary in effectiveness depending on the height of the golfer, and would be readily obfuscated by water or debris collected in the cup or by shadows in the cup.

Certain putter heads had rounded bottoms with scooped out bottom portions to minimize the slide or sled, such as is disclosed in Schmidt et al, U.S. Pat. No. 5,464,218, granted Nov. 7, 1995. Other putter heads provided an elevated bottom to raise the striking blade and reduce slide, as is disclosed in Wolf, U.S. Pat. No. 5,607,365, granted Mar. 4, 1997. Still other putter heads had hollowed out bottom portions for filling with different density materials, such as is disclosed in Baumann et al, U.S. Pat. No. 5,253,868, granted Oct. 19, 1993.

Many of the prior art golf putters heads, in attempting to solve alignment, slide or other putting problems, provided putter heads that were of convoluted design and construction, aesthetically displeasing, and unacceptable under professional golf rules and regulations.

The art desired a putter head which provided a true or correct level anchoring of the putter head with the putting surface, and which also provided improved eye alignment with consistently correct golfer head alignment, which provisions were readily and faithfully perceived by the golfer. The art desired a putter head, as immediately aforesaid, which also was aesthetically and functionally acceptable for professional golf use.

BRIEF DESCRIPTION OF THE DRAWINGS

FIG. 4 is an enlarged sectional view taken along line 4—4 of FIG. 1;

FIG. 5 is a sectional view taken along line 5—5 of FIG. 4;

FIG. 5A is a bottom plan view;

SUMMARY OF THE INVENTION

Figure 1:
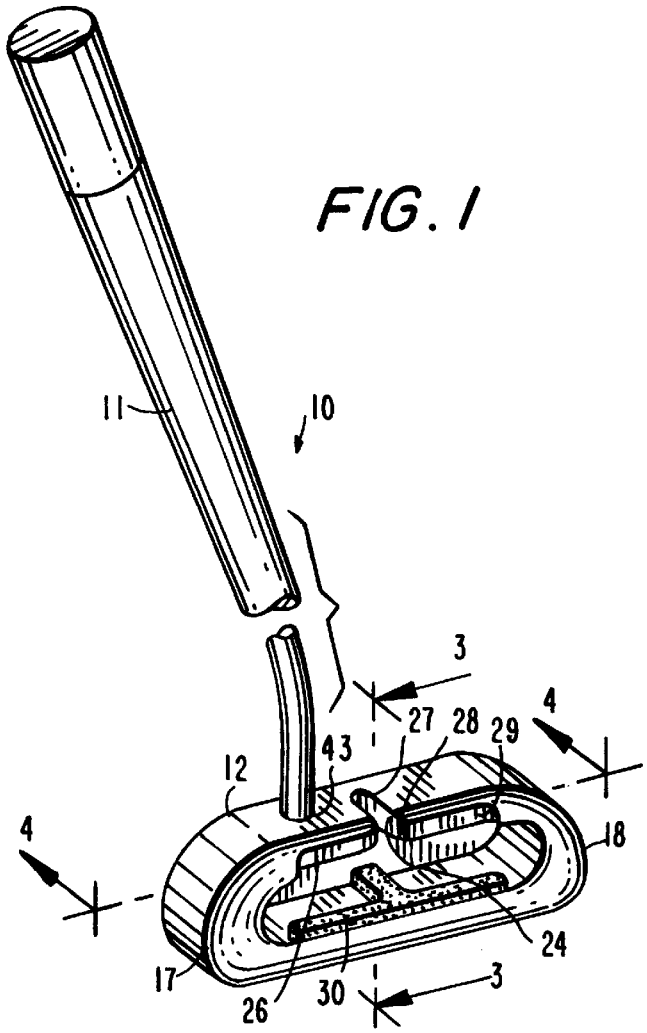
FIG. 1 is a rear perspective view of the golf putter of the present invention.
Figure 2:
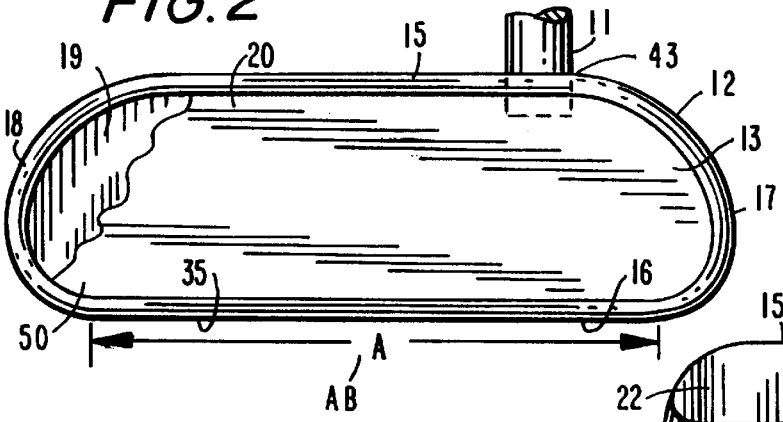
FIG. 2 is a front elevational view of the golf putter.

A golf putter of novel putter head design and construction which achieves correct golfer head alignment over the true target line of the ball is provided. The putter head, in general terms, has a limited surface area flat bottom face extending from a recess in the bottom in combination with golfer head alignment means. The limited surface area flat bottom face consistently provides true level anchoring with the putting surface as tactilely perceived by the golfer. The golfer, after level anchoring of the putter head, then by eye aligns the alignment means to achieve correct golfer head alignment. The recess covers a more substantial surface area of the bottom than the flat face. The alignment means is disposed at the back of the putter head, and is preferably comprised of two vertically displaced precision matched contoured elements disposed on spacedly disposed top and bottom flanges. At least one of the elements may be contrastingly colored for improved visual matching of the elements. The putter head bottom flat face is preferably of peripheral narrow annular configuration of limited surface area for increased tactile perception by the golfer.

DESCRIPTION OF THE INVENTION

Referring to the FIGS. there is shown the golf putter 10 of the present invention. Putter 10 is formed of shaft 11 and head 12, with shaft 11 disconnectably connected to head 12 at 43. Head 12 is formed of cast and machined metal construction, unless as otherwise described.

Putter head 12 has a forward or front portion 13, rearward or back portion 14, top portion 15, bottom portion 16 and opposed curved or rounded side portions 17 and 18. Front portion 13 is formed with a recess 19 into which a plastic or polymeric insert 20 is adhesively bonded at 21. Striking face 50 of insert 20 is the surface for striking the golf ball (not shown).

Figure 3:
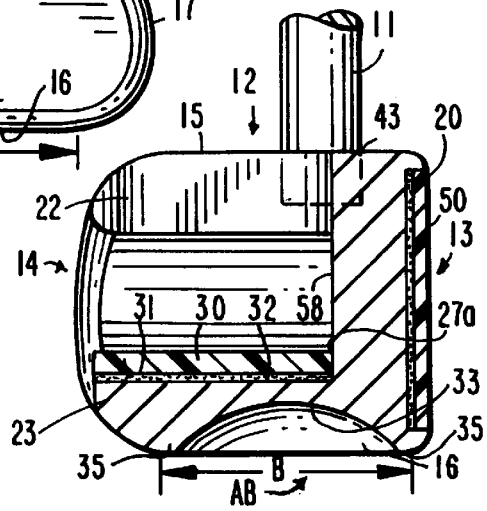
FIG. 3 is an enlarged sectional view taken along line 3—3 of FIG. 1.

Putter head 12 is formed with a top flange 22 and spacedly disposed bottom flange 23. Top flange 22 is formed with a machined contoured T-shaped cut-out 24, with the top 26 of the T of cut-out 24 disposed immediately adjacent back portion 14. T-shaped cut-out 24 is formed with contoured or rounded edges, e.g. 27, 28 and 29. A contoured T-shaped plastic insert 30 is machined to within 0.003 to 0.005 inch of cut-out 24, except for flat edge 27*a*. Flat edge 27*a* abuts vertical wall 58. Insert 30 is permanently adhesively bonded at 31 to surface 32 of bottom flange 23 (FIG. 3). Insert 30 is preferably of a distinctive bright or light reflective color, such as red, while the immediately adjacent surface 32 is preferably painted a low reflectively contrasting color, such as black. The head construction metal itself may be distinctly colored of relatively low reflectivety color. Cut-out 24 and contrastingly colored insert 30 are vertically aligned for purposes hereinafter appearing.

Referring specifically to FIGS. 2–5A, there is shown bottom portion 16. Bottom 16 is formed with an elongated recess 33 and a contiguous peripherally disposed annular flat face 35 as best shown in FIGS. 3 and 4. Bottom portion 16 encompasses a rectangular planar area AB defined as face length A by face width B. Face 35 is flat and contiguous to and bounded by rounded side portions 38, 39, rounded front portion 40, and rounded back portion 41. In this manner of construction, only annular flat face 35 first and substantially contacts the putting surface (not shown). Recess 33 encompasses a substantial part of and preferably more than about 50% of area AB. Flat face 35, preferably, comprises less than about 25% of area AB, and most preferably about 10 to 15% of area AB (FIG. 5A). Face 35 is, importantly, flat, peripherally disposed and of limited surface area, for purposes hereinafter appearing.

In the aforesaid manner of construction, the golfer places the putter head 12 on a putting surface with striking face 50 immediately adjacent the golf ball. The golfer then tactilely senses whether annular flat face 35 is level on and to the putting surface. The golfer moves the putter until assured that face 35 correctly anchors the head level on the putting surface. The golfer then aligns his or her eye with cut-out 24 and insert 30. That is, with flat face 35 disposed level to the putting surface and the golfer's eye directly aligned over cut-out 24 and insert 30, the golfer sees the red colored insert 30 fully within cut-out 24. The golfer then knowingly has correct golfer head alignment, and is ready to strike the ball.

Figure 6:
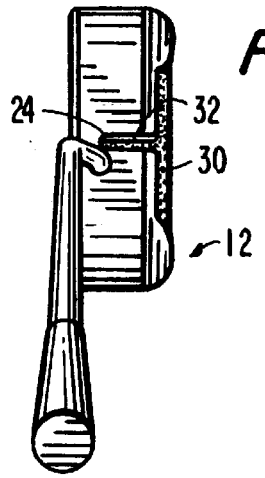
FIG. 6 is a top plan view as viewed by a golfer with proximal misalignment.
Figure 7:
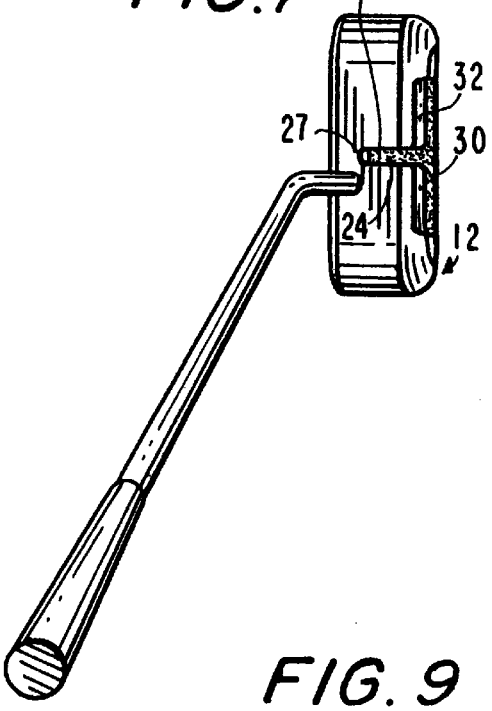
FIG. 7 is a top plan view as viewed by a golfer with rearward misalignment.
Figure 9:
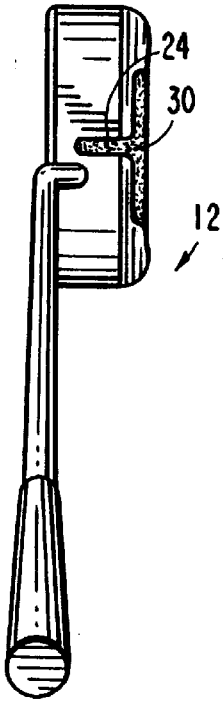
FIG. 9 is a top plan view as viewed by a golfer with correct alignment.
Figure 8:
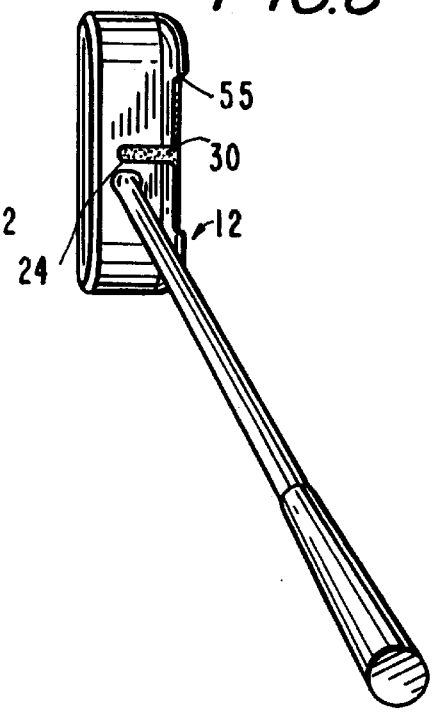
FIG. 8 is a top plan view as viewed by a golfer with forward misalignment.
Figure 10:
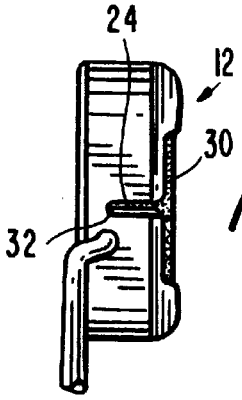
FIG. 10 is a top plan view as viewed by a golfer with distal misalignment.

If the golfer's head is too proximate, then the golfer will see white portion 32, as shown on FIG. 6. If the golfer's head is too rearward, then the golfer will see white portion 32 and flange surface 27, as shown in FIG. 7. If the golfer's head is too forward, the golfer will see less than the full insert 30 within cut-out 24 and observe indent or space 55, as shown in FIG. 8. If the golfer's head is too distal, the golfer will see white portion 32, as shown in FIG. 10. If the golfer's head is correctly directly aligned over cut-out 24 and insert 30, the golfer will see only red insert 30 within cut-out 24 without any white portion 32, flange surface 27 or indent 55 appearing, as demonstrated in FIG. 9. The golfer having anchored the head to the putting surface and correctly aligned his or her head behind and directly over the true line of the putt, may then strike the ball with the assurance of a correctly aligned putt.

Without wishing to be bound by any theory or mechanism, it is believed that the limited annular surface area of the bottom face provides increased pressure of the head on the putting surface which increased contact pressure is readily tactilely perceived by the golfer who thus feels when there is correct level anchoring of the head.

It is important to recognize that the putter of the present invention achieves a level or co-planar relationship of the putter bottom face with the putting surface, in contradistinction to having the putter head level to the earth as was the case in certain prior art constructions. That is, where the putting surface is on an incline, the present putter head will be anchored co-planar or level with the inclined surface. This is particularly important for long putts on an inclined putting surface.

The putter of the present invention is manufactured of metal casting and machined by means well known in the art, and the plastic or polymeric inserts are molded and machined by means well known in the art.

It is important to note that the golfer head alignment features of the present invention are, unlike prior art constructions, suitable for both right and left eyed dominant golfers, and of varying height. That is, the alignment accuracy is not effected by right eye or left eye alignment or by the height of the golfer.

While the invention is described in terms of a bottom face of an contiguous annular configuration, it is also within the contemplation to provide other configurations such as spacedly disposed flat face portions, particularly three equally spaced flat face portions providing a tripod anchoring effect. It is however further understood that such multiple bottom face portions as opposed to a single contiguous annular portion, provide multiple portion edges which might cause undue or adverse drag on the putting action.

What is claimed is:

1. A golf putter comprising, head means for striking a golf ball and shaft means for gripping the putter, and means for connecting the head means to the shaft means, said head means comprising bottom, top, front and back portions, said bottom portion being formed with recess means and face means for level anchoring of the putter head, with said face means extending around the recess means, said head means further comprising alignment means for aligning the golfer's head, said alignment means being disposed adjacent the back portion of the head means, wherein the head means comprises a top flange and a bottom flange, and wherein the alignment means comprises vertically displaced alignment means for golfer head alignment disposed respectively on the top flange and on the bottom flange, with each said alignment means being disposed adjacent the back portion of the head means, whereby the golfer contacts a putting surface with the face means to perceive correct level anchoring of the head means on the putting surface and then by eye aligns the alignment means for correct golfer head alignment.

2. The golfer putter of claim 1, said bottom portion comprising a planar area and said recess means comprising a more substantial part of the area than the face means.

3. The golf putter of claim 1, said face means comprising peripherally disposed surface means.

4. The golf putter of claim 3, said face means comprising flat surface means for level contact with the putting surface.

5. The golf putter of claim 4, said surface means comprising an annular contiguous surface.

6. The golf putter of claim 5, said head means comprising oppositely disposed side portions, wherein the face means is disposed in a plane, and said plane comprises an area bounded by the front, back and side portions, and wherein the face means comprises less than 50% of the area of the plane.

7. The golf putter of claim 1, wherein the alignment means comprises vertically displaced alignment means.

8. The golf putter of claim 1, said top flange alignment means and said bottom flange alignment means comprising substantially matching shaped elements.

9. The golf putter of claim 8, each said shaped element being T-shaped with the top part of each T-shape disposed immediately adjacent the back portion of the head means.

10. The golf putter of claim 8, wherein the top flange shaped element being a cut-out and the bottom flange shaped element comprises a substantially contour matching insert, and wherein the insert comprises means for providing a visual contrast with the bottom flange.

11. The golf putter of claim 1, wherein the top flange alignment means being formed with a shaped cut-out and the bottom flange alignment means comprises a shaped element operatively disposed directly below the shaped cut-out, whereby the golfer, after said level anchoring of the putter head, with correct golfer head alignment sees the shaped element fully within the cut-out.

12. The golf putter of claim 11, wherein the cut-out and element are within from about 0.003 to 0.005 inch in contour.

13. The golf putter of claim 1, said head means further comprising oppositely disposed side portions, and wherein the face means is disposed in a plane comprising a rectangular area.

14. The golf putter of claim 13, wherein the face means comprises less than about 25% of the area of the plane.

15. The golf putter of claim 14, said face means comprising an annular surface peripherally disposed in the plane.

16. The golf putter of claim 15, said annular surface being contiguous.

17. A golf putter comprising, head means for striking a golf ball and shaft means for gripping the putter, and means for connecting the head means to the shaft means, said head means comprising bottom, top, front, back and side portions, said bottom portion comprising a planar area bounded by said front, back and side portions, and said bottom portion being formed with recess means and face means for level anchoring of the putter head on a putter surface, with said face means comprising a flat surface means for first contacting the putter surface and said flat surface means extending around the recess means, said flat surface means being disposed in said planar area, and said flat surface means comprising less than 50% of the planar area, and said head means further comprising two vertically displaced alignment elements for aligning the golfers head, said two alignment elements being respectively disposed adjacent the top and bottom back portions of the head means, whereby the golfer first contacts the putting surface with the flat surface means thereby level anchoring the putter head means to the putting surface and shaft grip tactilely perceiving the level anchoring, and then by eye aligns the vertically displaced alignment means for correct golfer head alignment.

18. The golf putter of claim 17, said flat surface means comprises less than about 25% of the planar area.

19. The golf putter of claim 17, said flat surface means comprising an annular surface peripherally disposed adjacent the front, back and side portions.

20. The golf putter of claim 17, said vertically displaced alignment means comprising a top flange and a vertically spacedly disposed bottom flange, and wherein the top flange is formed with a shaped cut-out and the bottom flange comprises a shaped element operatively disposed below the shaped cut-out whereby the golfer having said correct golfer head alignment sees the shaped element fully within the cut-out.

21. The golf putter of claim 20, said shaped element being light reflective, and the head means adjacent the element being of a relatively low reflectivity color.

22. A golf putter comprising, a head and a shaft, and means for connecting the head to the shaft, the head having bottom, top, front and back portions, the bottom being formed with a recess and a surface extending around and peripherally disposed with respect to the recess for first contacting the putting surface for level anchoring of the putter head to the putting surface with shaft grip tactilely perceiving said level anchoring, and alignment elements being disposed adjacent the back portion, the alignment elements comprising vertically disposed first and second alignment elements, whereby the golfer first contacts the putting surface with the peripherally disposed bottom surface for said level anchoring of the putter head to the putting surface and then by eye aligns the vertically disposed first and second alignment elements for correct golfer head alignment with the putter head level anchored to the putting surface.

23. The golf putter of claim 22, said first alignment element comprising a contoured T-shaped cut-out formed in the top portion and said second alignment element comprising a contoured T-shaped insert in the bottom portion having the same contoured shape as the T-shaped cut-out so that the T-shaped contours are coincident in the golfer head alignment.

* * * * *